US010807260B2

(12) United States Patent
Hitchcock

(10) Patent No.: US 10,807,260 B2
(45) Date of Patent: Oct. 20, 2020

(54) REMOVABLE RAZOR CARTRIDGE WITH MAGNETIC ATTACHMENT

(71) Applicant: Edgewell Personal Care Brands, LLC, Chesterfield, MO (US)

(72) Inventor: Andrew Hitchcock, Bethany, CT (US)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 0 days.

(21) Appl. No.: 16/477,431

(22) PCT Filed: Apr. 10, 2018

(86) PCT No.: PCT/US2018/026833
§ 371 (c)(1),
(2) Date: Jul. 11, 2019

(87) PCT Pub. No.: WO2018/191229
PCT Pub. Date: Oct. 18, 2018

(65) Prior Publication Data

US 2020/0023531 A1 Jan. 23, 2020

Related U.S. Application Data

(60) Provisional application No. 62/484,032, filed on Apr. 11, 2017.

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/521; B26B 21/225
(Continued)

(56) References Cited

U.S. PATENT DOCUMENTS 2,385,859 A 10/1945 Jacobson
3,165,950 A 1/1965 Gooley et al.
(Continued)

FOREIGN PATENT DOCUMENTS

CN 101612740 12/2009
DE 102009050344 A1 5/2011
(Continued)

OTHER PUBLICATIONS

International Search Report of Application No. PCT/US2018/026833. filed Apr. 10, 2018.

*Primary Examiner* — Hwei-Siu C Payer

(57) ABSTRACT

A shaving system has a razor cartridge with a blade unit and handle connection structure having a first magnetic element, and a handle having a magnet mounted to the handle and an ejector button having a second magnetic element, movable between a first position and a second position. When the razor cartridge is attached to the handle and the ejector button is in its first position, the second magnetic element of the ejector button is positioned between the magnet of the handle and the first magnetic element of the razor cartridge. When the ejector button is moved to its second position, magnetic attraction between the magnet and the first magnetic element is reduced and the razor cartridge is unattached from the handle. When a user releases the ejector button, magnetic attraction between the magnet and the second magnetic element returns the ejector button to its first position.

11 Claims, 6 Drawing Sheets

(58) Field of Classification Search
USPC ..... 30/50, 532
See application file for complete search history.

(56) References Cited

U.S. PATENT DOCUMENTS

| | | | | |
|---|---|---|---|---|
| 5,956,851 | A * | 9/1999 | Apprille, Jr. | B26B 21/521 30/47 |
| 8,381,406 | B2 | 2/2013 | Miyazaki | |
| 9,550,303 | B2 * | 1/2017 | Robertson | B26B 21/165 |
| 9,687,989 | B2 * | 6/2017 | Robertson | B26B 21/52 |
| 9,764,487 | B2 * | 9/2017 | Robertson | B26B 21/10 |
| 10,016,903 | B2 | 7/2018 | McCambridge et al. | |
| 10,406,707 | B2 * | 9/2019 | Robertson | B26B 21/52 |
| 10,639,807 | B2 * | 5/2020 | Wilson | B26B 21/225 |
| 2013/0312265 | A1 | 11/2013 | Wilson et al. | |
| 2013/0312272 | A1 | 11/2013 | Wilson et al. | |
| 2015/0174776 | A1 | 6/2015 | Hawes | |
| 2016/0121495 | A1 | 5/2016 | Johnson | |
| 2016/0121498 | A1 | 5/2016 | Johnson | |
| 2016/0250764 | A1 * | 9/2016 | Hashimoto | B26B 21/225 30/47 |
| 2017/0326744 | A1 * | 11/2017 | Liberatore | B26B 21/521 |
| 2018/0079095 | A1 * | 3/2018 | Robertson | B26B 21/521 |
| 2019/0152079 | A1 * | 5/2019 | Chang | B26B 21/225 |
| 2019/0176355 | A1 * | 6/2019 | Mazarakis | B26B 21/225 |
| 2019/0232511 | A1 * | 8/2019 | Griffin | B26B 21/522 |
| 2020/0009754 | A1 * | 1/2020 | Provost | B26B 21/4012 |
| 2020/0023531 | A1 * | 1/2020 | Hitchcock | B26B 21/521 |
| 2020/0070376 | A1 * | 3/2020 | Petratou | B26B 21/225 |
| 2020/0156274 | A1 * | 5/2020 | Georgakis | B26B 21/52 |
| 2020/0246991 | A1 * | 8/2020 | Wilson | B26B 21/14 |

FOREIGN PATENT DOCUMENTS

| | | | |
|---|---|---|---|
| FR | 2 660 589 | * | 10/1991 |
| FR | 2 663 255 | * | 12/1991 |
| WO | 2014066183 | A1 | 5/2014 |

* cited by examiner

REMOVABLE RAZOR CARTRIDGE WITH MAGNETIC ATTACHMENT

TECHNICAL FIELD

The present disclosure relates to shaving systems having razor handles and razor cartridges, and more particularly to razor cartridges having magnetic attachment to a handle, the handle having structure to remove the cartridge.

BACKGROUND

There have been proposals in the patent literature for a safety razor including a handle and a razor cartridge selectively attached thereto by magnetic attachment. U.S. Pat. Nos. 8,789,282 and 9,579,809, and P.R.C. patent CN101612740B disclose exemplary devices.

Absent from the aforementioned patent literature is a handle including structure to enable the razor cartridge to be safely and conveniently selectively removed from the handle by a user without any necessity for the user to grasp and pull upon the razor cartridge.

SUMMARY

According to a first aspect of the present disclosure, a shaving system comprises a razor cartridge including a blade unit and a handle connection structure having a first magnetic element that can for example comprise nickel plated mild steel, and a handle. The handle has a cartridge connection end having a magnet mounted to the handle, e.g. in a recess of the handle, and an ejector button having a second magnetic element that can for example comprise a nickel plated soft ferrite and being movable by a user between a first position and a second position. When the razor cartridge is attached to the handle by magnetic attraction between the magnet and the first magnetic element, and the ejector button is in its first position, the second magnetic element of the ejector button is positioned between the magnet of the handle and the first magnetic element of the razor cartridge. When a user moves the ejector button to its second position (e.g. to selectively eject the razor cartridge), magnetic attraction between the magnet and the first magnetic element is reduced such that the razor cartridge is unattached from the handle. When a user releases the ejector button at its second position, magnetic attraction between the magnet and the second magnetic element returns the ejector button to its first position.

In an embodiment of the first aspect, the blade unit is pivotally connected to the handle connection structure.

In another embodiment of the first aspect, when the razor cartridge is attached to the handle and the ejector button is in its first position, the second magnetic element of the ejector but button is positioned one of directly and indirectly between the magnet of the handle and the first magnetic element of the razor cartridge. For example, the second magnetic element can be provided with an aperture, the second magnetic element can partially straddle the magnet such that the first magnetic element can be positioned relatively closer to the magnet.

In a further embodiment of the first aspect, the ejector button is slidable on the handle, e.g. slidable along the handle between the first position and the second position. In any embodiment, movement of the ejector button between the first position and second position is movement in a direction relatively towards the attached razor cartridge.

Accordingly, the razor cartridge can be readily removed from the handle by a user without any necessity for the user to grasp and pull upon the razor cartridge. The direction of movement of the ejector button is familiar to a user of typical shaving systems. These and other advantages of the present disclosure will be apparent to one of ordinary skill in the art in light of the following Detailed Description and Drawings.

BRIEF DESCRIPTION OF THE DRAWINGS

Reference is made to the attached drawings, wherein elements having the same reference numeral designations represent like elements throughout, and wherein.

DETAILED DESCRIPTION OF THE PREFERRED EMBODIMENTS

Figure 1:
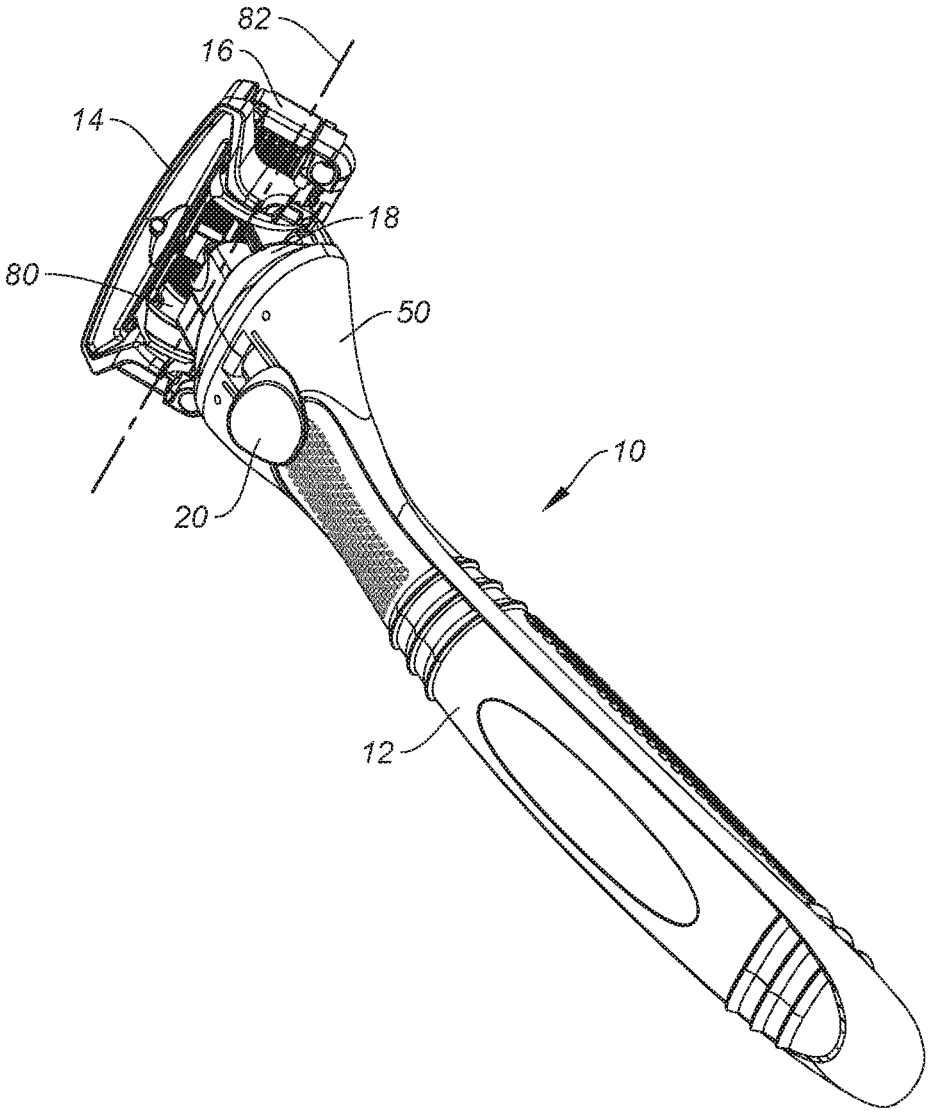
FIG. 1 is a perspective view of a shaving system of the present disclosure.

Referring now to the figures, FIG. 1 depicts a shaving system 10. The shaving system 10 comprises a razor handle 12 and a razor cartridge 14. The razor cartridge 14 comprises a blade unit 16 and a handle connection structure 18. The blade unit 16 can be pivotally connected to the handle connection structure 18 such that the blade unit 16 can pivot relative to the handle connection structure 18 about an axis 82 generally parallel to blade cutting edge(s) of the blade unit 16. Pivotal connection can be provided by shell bearing structure 80 or other suitable structure. The razor handle 12 includes a user-operated ejector button 20 at a cartridge connection end 50 of the handle 12.

Figure 2:
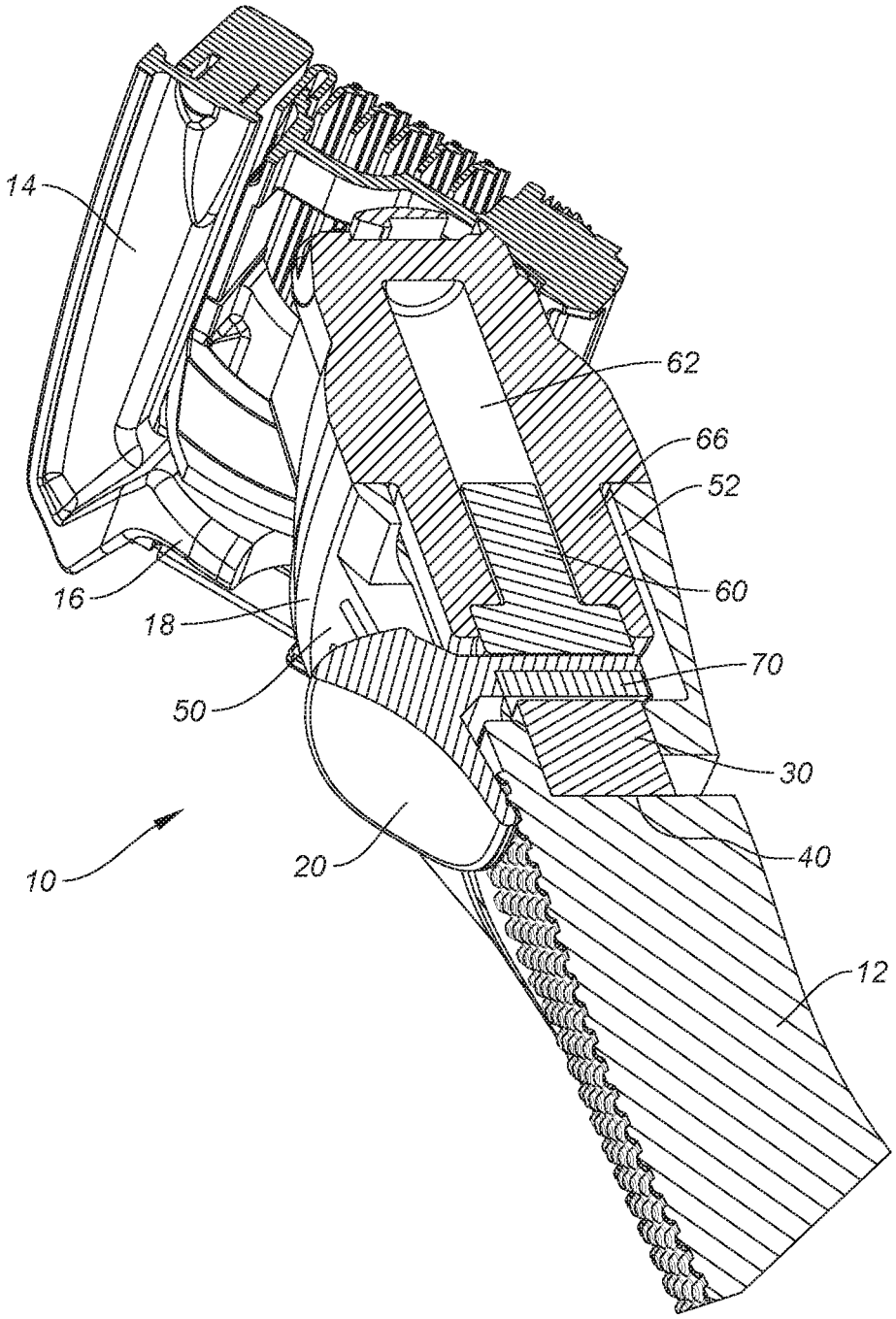
FIG. 2 is a detailed perspective longitudinal sectional view of the shaving system, with the ejector button in a first position.

Referring now to FIG. 2 which depicts the first stage in an operation sequence shown sequentially in FIGS. 2-5. The shaving system 10 has its razor cartridge 14 mounted on a razor handle 12. In FIG. 2, the razor handle 12 includes a magnet 30 that can for example preferably be fixedly received in a recess 40 or otherwise fixedly mounted to the handle 12. The ejector button 20 is in a first position relative to the razor handle 12. The ejector button includes a (second) magnetic element 70 fixed thereto. The razor cartridge 14 has a handle connection structure 18 that includes a (first) magnetic element 60. The first magnetic element 60 can also be fixedly received in a recess 62 of the handle connection structure 18, or otherwise fixed to the handle connection structure 18. The first and the second magnetic elements 60, 70 are closely spaced to the magnet 30 with the second magnetic element 70 between the magnet 30 and the first magnetic element 60. As depicted, magnetic attraction between the magnet 30 and the second magnetic element 70 retains the ejector button 20 in the first position. Magnetic attraction both directly from the magnet 30 and secondarily via the second magnetic element 70 retains the razor cartridge 14 on the handle 12 for use as a shaving system.

In the context of the present disclosure the magnet 30 can be an electromagnet or any "permanent" magnet selected from a group including but not limited to ceramic magnets, alnico magnets, samarium cobalt magnets, neodymium iron boron magnets, and any combination thereof. So-called "rare earth" magnets such as neodymium iron boron magnets are particularly preferred. The magnet 30 can also be plated (e.g. with nickel) or thinly coated (e.g. with plastic or rubber) to respectively resist corrosion caused by the shaving environment and to resist chipping if accidental impact occurs between the magnet 30 and another hard or metallic object.

In the context of the present disclosure the first and second magnetic elements 60, 70 are any material of a composition size and shape that are attracted with sufficient magnetic force to the magnet 30. The magnetic element 60 should preferably have an attractive force of at least about 2 N to the magnet 30 in the arrangement of FIG. 2. The magnetic element 70 should preferably have an attractive force of at least about 2 N to the magnet 30 in the arrangement of FIGS. 3 and 4. Magnetic elements 60, 70 can preferably be ferrous (i.e. iron containing) or another ferromagnetic material, such as nickel or cobalt or alloys of any of these three materials. Magnetic elements 60, 70 can be made from mild steel (i.e. steel with a low carbon content, for example 0.05-0.25%) for benefits of ease of manufacture (shaping) and manufacturing cost, or soft ferrite for benefits of low coercivity. The magnetic elements 60, 70 can also be plated (e.g. with nickel) for the benefit described above. The magnetic elements 60, 70 can be the same material or can be different materials chosen from the above, for example the first magnetic element 60 can be mild steel and the second magnetic element 70 can be soft ferrite, e.g. manganese-zinc ferrite or nickel-zinc ferrite. One or both magnetic elements 60, 70 can also be a so-called "heavy plastic" i.e. a polymer (e.g. an amorphous or semi-crystalline thermoplastic) containing a substantial portion (e.g. more than about 65% by weight) iron oxide, iron or steel particles. In these instances, one or both magnetic elements 60, 70 can be integrally formed, i.e. molded with their respective mounting structures (respectively handle connection structure 18 and ejector button 20).

Figure 3:
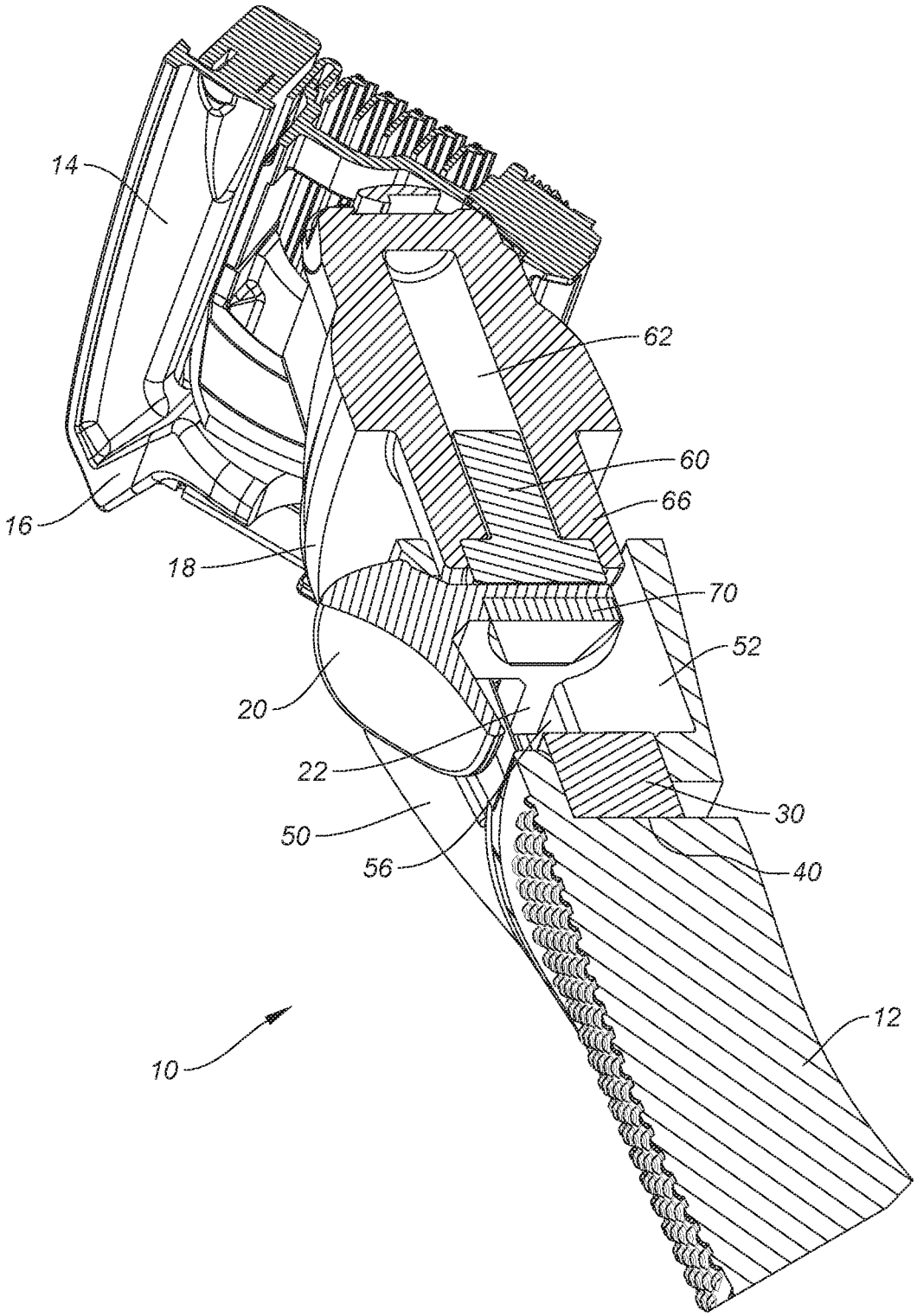
FIG. 3 is a detailed perspective sectional view of the shaving system, with the ejector button in a second position.

Referring now to FIG. 3, when a user wishes to remove the razor cartridge 14 from the handle 12, e.g. if the blades of the razor cartridge 14 are perceived to be dull, the user pushes the ejector button 20 to the second position, in a direction relatively towards the razor cartridge. In doing so, the ejector button 20 slides along the razor handle for example by an arrangement of lateral projections 22 of the ejector button (see FIG. 6) engaging suitable tracks 56 of the razor handle 12.

Figure 4:
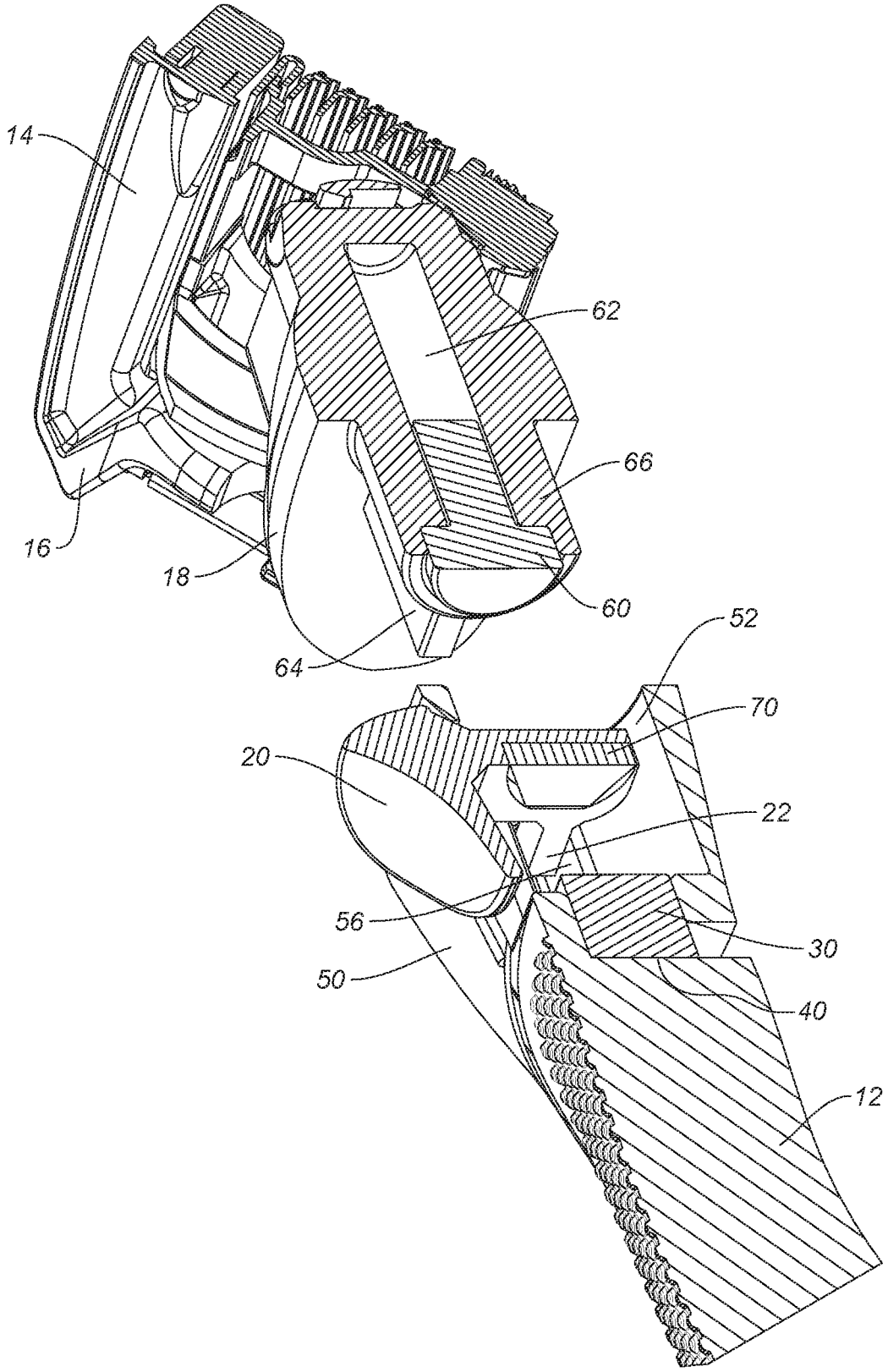
FIG. 4 is a detailed perspective sectional view of the shaving system, with the ejector button in a second position, and the razor cartridge being ejected.

Referring now to FIG. 4, when the ejector button 20 is in the second position, the magnetic attraction between the magnet 30 and the first magnetic element 60 due to the interspacing therebetween is removed or substantially reduced such that the razor cartridge 14 is no longer attached to the handle 12.

Figure 5:
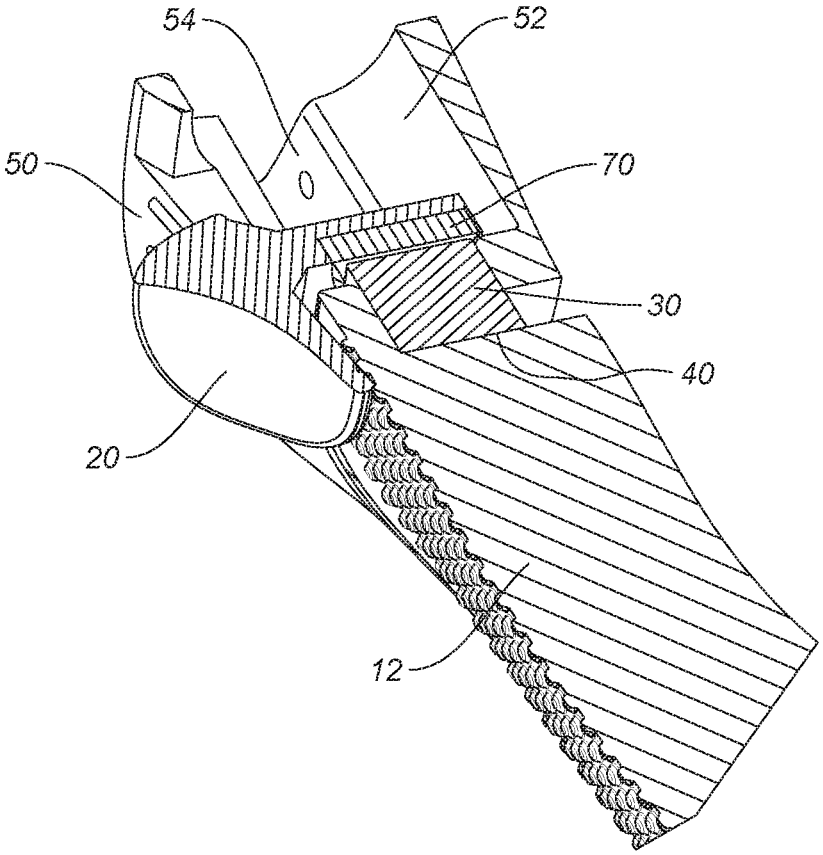
FIG. 5 is a detailed perspective sectional view of the razor handle with the ejector button in a first position.

Referring now to FIG. 5, when a user releases the ejector button 20, magnetic attraction between the magnet 30 and the second magnetic element 70 causes the ejector button 20 to return to its first position independently of any action (i.e. application of forces) by the user. The user is then able to attach another razor cartridge 14 to the handle 12.

As can more clearly be seen in FIG. 4 and FIG. 5, as depicted the handle connection structure 18 of the razor cartridge is a protrusion 66 that is received in a recess 52 of the handle 12. This arrangement can be reversed such that a protrusion of the handle is received in a recess 52 of the handle connection structure 18. As depicted, the handle connection structure 18 is provided with a (lateral) projection 64 provided to ensure or enhance correct orientation of the razor cartridge 14 on the handle 12 and to resist relative rotation when the projection 64 is received in its respective recess 54 of the handle. The present disclosure should not be limited to specific types of projections and any suitable shape of the handle connection structure is within the scope of the present disclosure.

Figure 6:
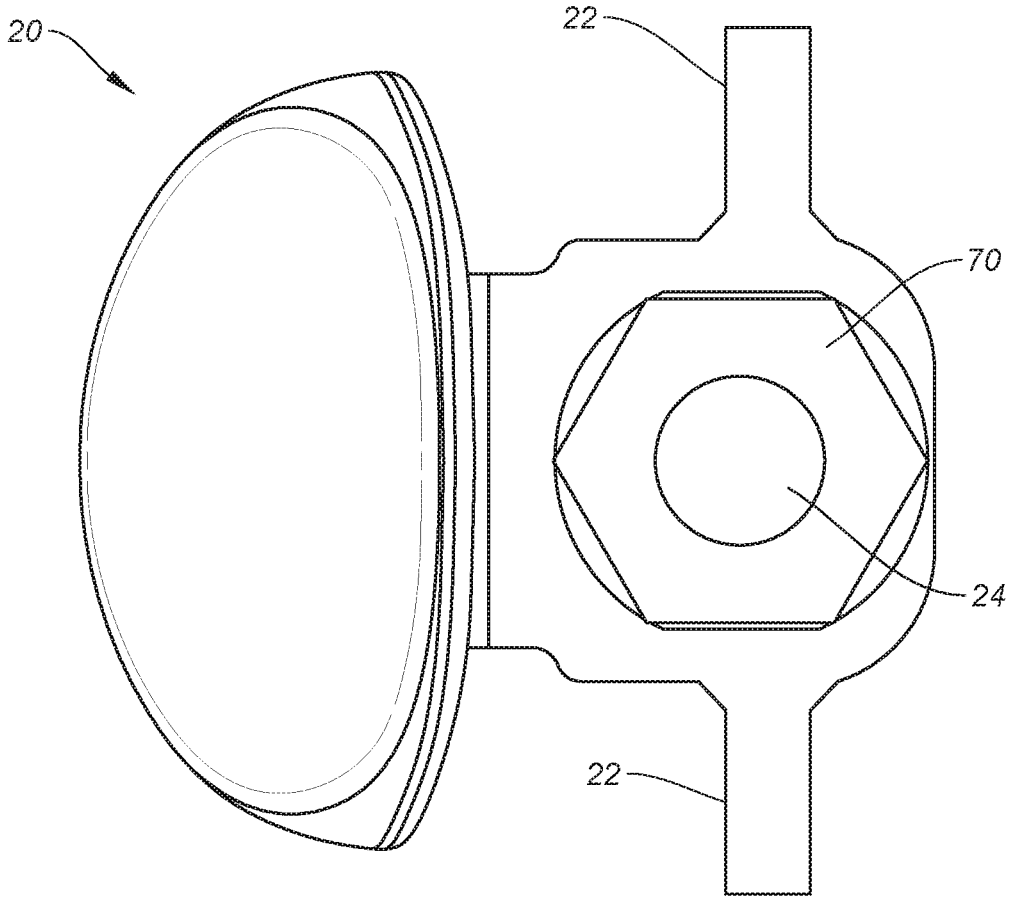
FIG. 6 is an end view of another ejector button.
Figure 7:
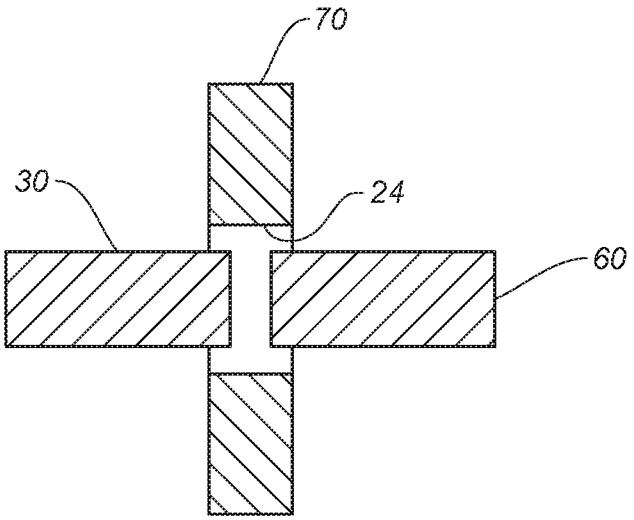
FIG. 7 is a schematic view of the arrangement of the ejector button of FIG. 6 with the associated magnet and first magnetic element of this shaving system.

Referring now to FIGS. 6-7, other arrangements of the ejector button 20 and its second magnetic element 70 are depicted, as described below.

In FIG. 6, the second magnetic element 70 and optionally the ejector button 20 are provided with an aperture 24. The aperture 24 can be an open slot or a bounded opening and can be a through-aperture or blind. The aperture 24 can be sized to receive the magnet 30. In this arrangement, the second magnetic element 70 can fully or partially straddle the magnet 70 to enable (in the state of FIG. 2) the first magnetic element 60 to be closer spaced to the magnet 30 to enhance the attraction force between the magnet 30 and the first magnetic element 60. This arrangements shown schematically in FIG. 7.

Those skilled in the art will recognize that variations and modifications can be made without departing from the true scope of the disclosure as defined by the claims that follow. For instance, features disclosed in connection with any one embodiment can be used alone or in combination with each feature of the respective other embodiments.

What is claimed is:

1. A shaving system comprising:

a razor cartridge including a blade unit, and a handle connection structure having a first magnetic element, and a handle having a cartridge connection end having a magnet mounted to the handle, and an ejector button having a second magnetic element, the ejector button being movable by a user between a first position, and a second position, and wherein, when the razor cartridge is attached to the handle and the ejector button is in its first position, the second magnetic element of the ejector button is positioned between the magnet of the handle and the first magnetic element of the razor cartridge;

when the user moves the ejector button to its second position, magnetic attraction between the magnet and the first magnetic element is reduced such that the razor cartridge is unattached from the handle; and when the user releases the ejector button at its second position, magnetic attraction between the magnet and the second magnetic element moves the ejector button to its first position.

2. The shaving system of claim 1, wherein when the razor cartridge is attached to the handle and the ejector button is in its first position, the second magnetic element of the ejector button is positioned one of directly and indirectly between the magnet of the handle and the first magnetic element of the razor cartridge.

3. The shaving system of claim 1, wherein the blade unit is pivotally connected to the handle connection structure.

4. The shaving system of claim 1, wherein the ejector button is slidable on the handle between the first position and the second position.

5. The shaving system of claim 1, wherein the second magnetic element has an aperture.

6. The shaving system of claim 1, wherein, the magnet is received in a recess of the handle.

7. The shaving system of claim 1, wherein the first magnetic element is selected from the group consisting essentially of steel, mild steel, and nickel plated mild steel.

8. The shaving system of claim 1, wherein the second magnetic element comprises soft ferrite.

9. The shaving system of claim 8, wherein the soft ferrite is one of manganese-zinc ferrite and nickel-zinc ferrite.

10. The shaving system of claim 1, wherein movement of the ejector button from the first position to the second position is in a direction towards the attached razor cartridge.

11. The shaving system of claim 1, wherein, when the user releases the ejector button at its second position, movement of the ejector button to its first position is achieved by the magnetic attraction between the magnet and the second magnetic element.

* * * * *